US008720243B2

(12) United States Patent
Sperrer

(10) Patent No.: US 8,720,243 B2
(45) Date of Patent: May 13, 2014

(54) SWITCHING DEVICE, ESPECIALLY FLOOR SWITCH, FOR A PRODUCTION DEVICE

(75) Inventor: Gerhard Sperrer, Oberschlierbach (AT)

(73) Assignee: Trumpf Maschinen Austria GmbH & Co. KG, Pasching (AT)

( * ) Notice: Subject to any disclaimer, the term of this patent is extended or adjusted under 35 U.S.C. 154(b) by 1061 days.

(21) Appl. No.: 12/095,522

(22) PCT Filed: Nov. 29, 2006

(86) PCT No.: PCT/AT2006/000490

§ 371 (c)(1),
(2), (4) Date: Sep. 16, 2010

(87) PCT Pub. No.: WO2007/062441

PCT Pub. Date: Jun. 7, 2007

(65) Prior Publication Data

US 2010/0326800 A1 Dec. 30, 2010

(30) Foreign Application Priority Data

Nov. 30, 2005 (AT) ..... 1928/2005

(51) Int. Cl.
*B21D 55/00* (2006.01)

(52) U.S. Cl.
USPC ..... 72/20.1; 72/20.5; 72/31.01; 72/37; 72/419

(58) Field of Classification Search
USPC ..... 72/20.1, 20.2, 20.3, 20.4, 20.5, 21.1, 72/31.01, 37, 419, 420, 421; 700/228, 700/229, 230, 245, 250, 253; 340/573.1
See application file for complete search history.

(56) References Cited

U.S. PATENT DOCUMENTS

| | | | | |
|---|---|---|---|---|
| 3,881,606 | A * | 5/1975 | Swinehart | 198/750.7 |
| 5,635,777 | A | 6/1997 | Telymonde et al. | |
| 6,753,776 | B2 * | 6/2004 | Drinkard | 340/540 |
| 7,119,704 | B2 * | 10/2006 | Grzan et al. | 340/665 |
| 7,176,397 | B2 * | 2/2007 | Grzan | 200/85 R |
| 7,321,305 | B2 * | 1/2008 | Gollu | 340/572.1 |
| 7,818,985 | B2 * | 10/2010 | Ikeda et al. | 72/20.2 |
| 7,954,621 | B2 * | 6/2011 | Brandt et al. | 198/341.01 |

FOREIGN PATENT DOCUMENTS

| | | |
|---|---|---|
| AT | 333 160 B | 2/1976 |
| DE | 0 454 269 | 10/1991 |
| DE | 43 14 104 | 11/1994 |
| DE | 69 115 553 | 5/1996 |

(Continued)

OTHER PUBLICATIONS

The International Search Report for PCT Application No. PCT/AT2006/000490; Filed Nov. 29, 2006; Date of Completion Apr. 17, 2007; Date of Mailing Apr. 25, 2007.

(Continued)

*Primary Examiner* — Edward Tolan
(74) *Attorney, Agent, or Firm* — Alston & Bird LLP

(57) ABSTRACT

The invention describes a switching device which can be variably positioned (45), in particular a foot switch (47), which is connected, preferably wirelessly, to a control device (46) optionally co-operating with a production unit (1), in particular a press brake (2), for transmitting signals and/or data. A positioning system (50) is provided as a means of changing the position when necessary, which comprises at least a detection unit (51) and a drive system (52) in the form of a bogie provided with a drive mechanism and at least one drive member.

27 Claims, 7 Drawing Sheets

(56) References Cited

FOREIGN PATENT DOCUMENTS

| | | | | | |
|---|---|---|---|---|---|
| DE | 201 05 851 | | 10/2001 | | |
| JP | 2001-150033 | A * | 6/2001 | ..... | B21D 5/02 |
| JP | 2005 319515 | | 11/2005 | | |
| JP | 2006-162300 | A * | 6/2006 | ..... | G01L 5/00 |

OTHER PUBLICATIONS

The Written Opinion for PCT Application No. PCT/AT2006/000490; Filed Nov. 29, 2006; Date of Completion Apr. 17, 2007; Date of Mailing Apr. 25, 2007.

Austrian Office Action dated Jun. 2, 2006.

* cited by examiner

SWITCHING DEVICE, ESPECIALLY FLOOR SWITCH, FOR A PRODUCTION DEVICE

BACKGROUND OF THE INVENTION

The invention relates to a switching device which can be variably positioned, in particular a press brake, which is connected, preferably wirelessly, to a control device which may cooperate with a production unit, in particular a press brake, for transmitting signals and/or data, and a production unit, in particular a press brake, for shaping workpieces of sheet metal, with at least one control device which is connected, preferably wirelessly, to a switching device, which can be variably positioned as necessary, for transmitting signals and/or data.

Switching devices are used in a broad range of applications for controlling and regulating different sequences, parameters, etc. The switching devices specifically used with production units as a means of controlling work steps, production sequences, etc., are commonly provided in the form of foot switches to permit easy operation or manipulation by an operator. If the operator using the production unit has to go off to another location, the operator must manually re-position the switching device so that he can continue to control the switching device and thus enable other work steps or sequences of the production unit to be initiated by operating the switching device. Such switching devices are used on press brakes, for example, and in this instance a workpiece of sheet metal is preferably formed between two bending tools when the switching device is operated, but it may be that the operator has to move to another area because the sheet metal workpiece often has to be exactly positioned in the press brake from more than one side to ensure accurate production. This manual re-positioning of the switching device is very time-consuming and does not lend itself to a rapid work sequence at the production unit, thereby significantly increasing the cost of the production process at the production unit.

Various possible switching devices have been described in the prior art which permit a change in operating position.

Such a switching device is described in patent specification DE 691 15 553 D2. The described switching device, which can be depressed from any point, is provided in the form of a switch mat, which has a detector for detecting a change in pressure at any point within an operating zone, and the switching device has flexible top and bottom layers which enable the switching device to be adapted to the ground underneath within certain limits and which are of a moisture-resistant and anti-slip design. The switch mat also contains a power source and a generator for electromagnetic waves, which is actively connected to the detector so that an electromagnetic wave is sent to a point remote from the switching device in response to a detected change in pressure at any point within the operating zone.

The disadvantage of such a switching device is that if a large operating zone is required, the switch mat must have a wide extension along a standing surface, which means that extra space is needed which can not be used for other purposes except under certain conditions because of the size of the switch mat. Apart from this aspect, the costs of using such a switch mat are also significantly increased due to the higher production costs incurred as a result of using a switch mat of large dimensions. One disadvantage is the fact that the switching device takes up a large area of a standing surface in order to provide a wide operating zone on the one hand, but the space occupied by the switch mat must be limited to an area which is not in the immediate working range of an operator in order to prevent inadvertent operation on the other hand. This being the case, it is not possible to use the switch mat in an area of standing surface which the operator has to walk on, which means that the operator constantly has to orient himself depending on the position of the switch mat in order to operate it correctly.

Patent specification AT 333160 also discloses a physically operated work contact which is carried on the body of a person and has a miniature transmitter which is actively connected to a remote receiver. The physically operated work contact is disposed in a shoe, on the sole in the region of the toes, and has two contact elements and a transmitter, which emits control signals when the contact elements are closed.

The disadvantage of this approach is that there is a possibility of unintentionally operating the alarm signal transmitter, which would mean that it would only be possible to use a production unit, such as a press brake for example, under certain conditions and possibly not at all because the requisite safety conditions of the switching device to prevent inadvertent operation are not fulfilled. Another disadvantage is the fact that in order to be able to operate the alarm signal transmitter from any location, it has to be disposed in a special shoe or a special sole, and it is also preferable to provide a transmitter in the shoe sole, and an operator must therefore be equipped with special shoes, which also incurs extra costs. The switching device is also limited to a very small and lightweight design to avoid hampering the operator, which makes it impossible to equip the switching device with a broad range of functions.

The objective of the invention is to propose a switching device and a production unit designed to permit easy positioning of the switching device.

This objective is achieved by the invention due to the characterizing features defined in claim 1. The surprising advantage of this approach is that the position of the switching device can be varied and a change in position takes place automatically whenever a change in the position of an element to be detected is perceived. This saves time when it comes to operating the switching device because the operator controlling the switching device does not have to move depending on the position of the switching device and instead, the switching device is automatically positioned so that easy operation is possible, thereby cutting costs, and changes in position can be perceived in an area to be detected and then evaluated by the control unit, after which control signals can be transmitted to a drive system to enable accurate positioning of the switching device.

Also of advantage are embodiments defined in claims 2 and 3 because monitoring of an area or section can be guaranteed and any changes in the position of elements to be detected can be easily detected.

Another advantageous embodiment is described in claims 4 to 8, the resultant advantage being that equipment which provides accurate measurements and has been tried and tested can be used for monitoring purposes.

The embodiments defined in claims 9 and 10 also offer advantages because the switching device or production unit may be designed to fulfill the detection function if necessary, or the detection accuracy can be improved if necessary by using different detection methods.

The advantage of an embodiment defined in claims 11 to 15 is that the change in position or positioning operation of the switching device can be controlled and regulated, thereby enabling exact positioning.

Other advantageous embodiments are defined in claims 16 to 19, whereby the position of the switching device can be changed independently of the production unit and the direction of the switching device can be easily changed.

An embodiment defined in claim 20 is of advantage because devices which specifically require electrical power for operation can be used in the switching device.

An embodiment defined in claim 21 is of advantage because it permits easy operation of the switching device.

The advantage of the embodiments defined in claims 22 and 23 is that the switching device can be operated wirelessly, thereby avoiding cables and wiring which could otherwise compromise operating safety.

An embodiment defined in claim 24 offers a simple way of operating the switching device.

Also of advantage is an embodiment defined in claim 25, because easy movement of the switching device can be guaranteed and all the desired devices can be reliably accommodated on the switching device.

The embodiments defined in claims 26 and 27 are also of advantage because different operating modes, settings, etc., can be defined in a simple manner and rendered visible.

The advantages gained correspond to at least some of those described above in connection with the embodiments specified in claims 1 to 27 or will become apparent from the description given below.

BRIEF DESCRIPTION OF THE DRAWINGS

The invention will be described in more detail below with reference to examples of embodiments illustrated in the appended drawings.

DETAILED DESCRIPTION

Figure 1:
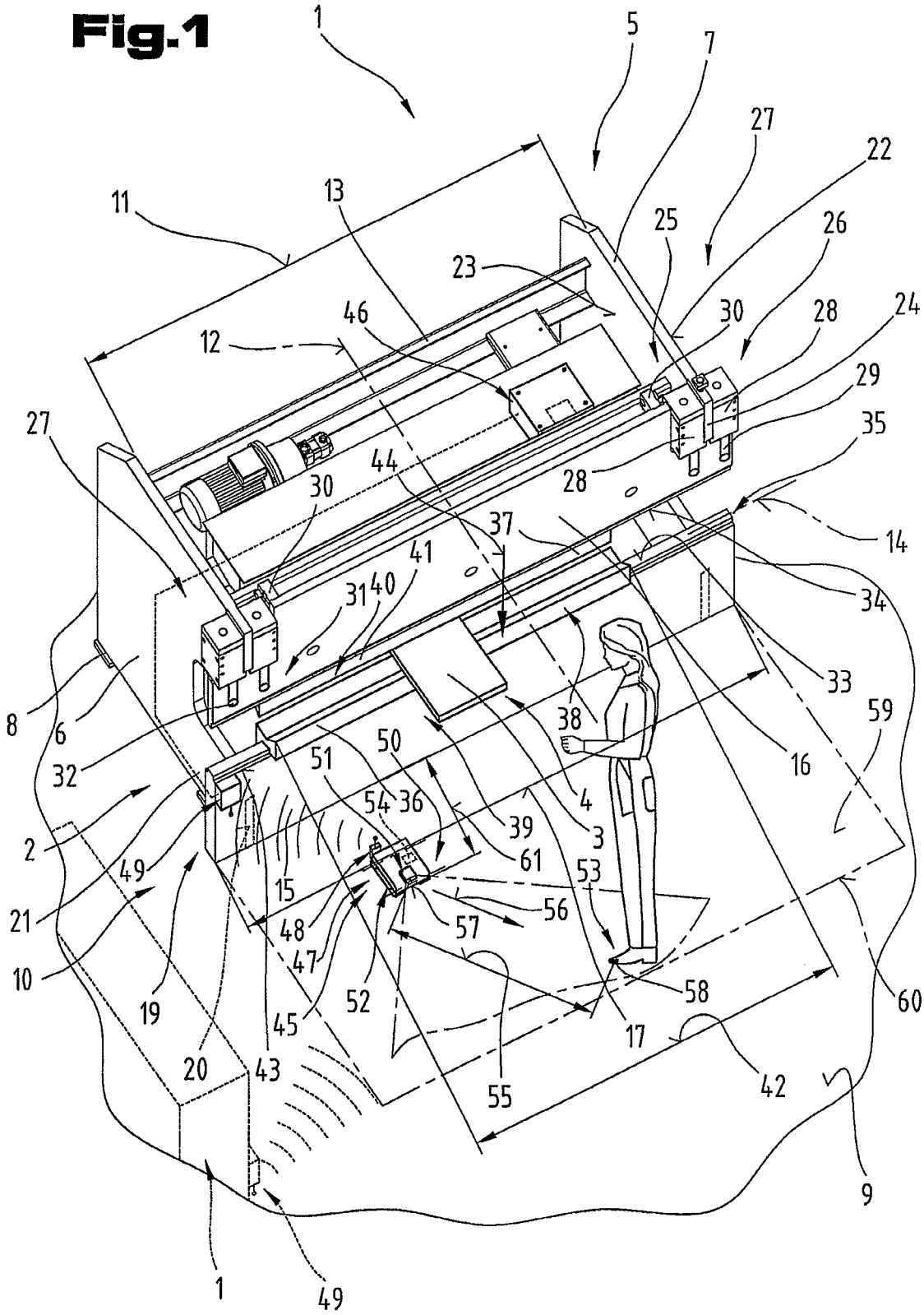
FIG. 1 is a highly simplified, perspective view of a production unit with a switching device proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 illustrates a production unit 1, in particular a press brake 2, for shaping workpieces 3 in particular, e.g. to produce housing parts 4, sections etc. These production units 1 are also used to manufacture elongate sections, e.g. angled sections, U-sections, Z-sections etc. with a generally very long length relative to the cross-section.

A machine frame 5 of the production unit 1 essentially comprises two parallel C-shaped stand side panels 6, 7 spaced at a distance apart from one another, which may be supported directly, or if necessary, via damping elements 8, on a standing surface 9 or, in another embodiment illustrated as an example, secured to a common base plate 10, in particular welded to it. The stand side panels 6, 7 are also connected to one another at a distance 11 apart by means of wall parts 13 extending perpendicular to a mid-axis 12.

By reference to a working plane 14 extending parallel with the standing surface 9, the production unit 1 has two oppositely lying press beams 15, 16 extending across a length 17 which is generally determined by the respective machine size and the working length provided for bending the workpieces 3.

The press beam 15 directed towards the standing surface 9 is secured to the machine frame 5 by means of a fixing arrangement 19, preferably directly on end faces 20 of legs 21 of the C-shaped stand side panels 6, 7 co-operating with the plate 10, in particular by means of screw bolts or welding. Disposed on end faces 22, 23 of legs 24 of the C-shaped stand side panels 6, 7 spaced apart from the standing surface 9 are actuator drives 25, 26 of the drive system 27, which can be operated by a pressurizing medium, comprising double-acting hydraulic cylinders 28. Actuator elements 29, e.g. piston rods of the hydraulic cylinders 28, are drivingly connected to the press beam 16, mounted in guide arrangements 30 of the machine frame 5 in a direction extending perpendicular to the working plane 14 so that they can be displaced by means of pivot bearings 31 and bolts 32, for example. The press beam 15 and press beam 16 extend across the length 17 more or less symmetrically and the direction perpendicular to the mid-plane 12, and the length 17 is slightly longer than the distance 11.

On mutually facing end faces 33, 34 extending parallel with the working plane 14, the press beams 15, 16 have tool holders 35 for supporting and releasably attaching bending tools 36, 37. In a manner known from the prior art, these bending tools 36, 37 generally constitute a bending die 39 in the form of a female die 38 and a bending punch 41 in the form of a male die 40. As also known from the prior art, the bending tools 36, 37 are divided into sections, thereby enabling a tool length 42 to be easily varied in order to adapt to respective requirements and also to make it easier to set up the production unit 1 again or change the bending tools 36, 37.

The tool holders 35 in the press beams 15, 16 are designed on the one hand to releasably secure the bending tools 36, 37, and on the other hand serve as support surfaces 43 for transmitting bending forces—as indicated by arrow 44.

The production unit 1 further comprises a switching device 45, which is connected to the control device 46 in order to transmit signals and/or data.

At this stage, it should be pointed out that the switching device 45 is not restricted to use with the production unit 1 and instead, the switching device 45 may also be used with other production units or devices known from the prior art. For example, the switching device 45 may optionally operate in the manner of a remote control or remote system, which is actively connected to a known control system, and the control system at least partially controls a device on the basis of the switching state or switching states of the switching device 45.

These might be the control system or control device 46 of processing plants, processing machines, production units, forming devices for workpieces, in particular sheet metal parts, electronic devices such as electrical devices, etc., for example.

Use of the switching device 45 in combination with the production unit 1 described above is merely a preferred application of the switching device 45, and it is even possible to use only one switching device 45 on several different and/or identical production units or devices.

It is of particular advantage to use the switching device 45 with the production unit 1, in particular the press brake 2, because the workpieces 3 processed on press brakes 2 usually have to be manually positioned by an operator, and when the switching device 45 is operated, a control signal is transmitted to a control device 46 of the production unit 1, which initiates the forming operation of the workpiece 3 by means of the bending tools 36, 37, preferably by displacing the press beam 16. As result of this approach, the switching device 45 is preferably provided as a foot switch 47 to enable easy operation of the production unit 1 by the operator.

The switching device 45 is also connected so that it can communicate with the control device 46 of the production unit 1, preferably wirelessly, in order to transmit signals and/or data. The communication link is preferably established by electromagnetic waves, in particular radio waves, between transmitter and/or receiver units 48, 49, in a manner long known from the prior art, and the way in which this wireless communication link operates will therefore not be described. It should merely be pointed out that one of the transmitter and/or receiver units 48 is assigned to the switching device 45 and may be mounted on it, and is wirelessly connected so as to communicate with at least the transmitter and/or receiver unit 49 assigned to the production unit 1, and the signal and/or data transmission may also be run using another method, e.g. infrared.

The transmitter and/or receiver unit 48 of the switching device 45 may also be connected so as to communicate with several different transmitter and/or receiver units 49 of several production units 1 in order to transmit signals and/or data, as indicated by broken lines in FIG. 1. The switching device 45 may also be provided with several transmitter and/or receiver units 48, each of which is linked to a co-operating point. The transmitter and/or receiver units 48, 49 may each be configured so that signals can be received and/or transmitted. It would naturally also be possible to opt for a hard-wired communication link, in which case it may be provided in the form of a data cable, data bus, etc., between the switching device 45 and control device 46.

To enable its position to be changed as necessary, the switching device 45 is provided with a positioning system 50, which comprises at least one detection unit 51 and a drive system 52.

Providing the positioning system 50 now means that the switching device 45 can be automatically positioned, preferably at a foot 53 of the operator, without the need for further action on the part of the operator. When the operator moves to a different location, this is automatically detected via the detection unit 51 and the drive system 52 is activated and switched on in order to position the switching device 45 until the switching device 45 has assumed a certain position relative to the operator's foot 53. The advantage of this is that it totally obviates the need for the operator to re-position the switching device 45 manually and no other action is needed for the positioning operation. Instead of positioning the switching device 45 at an operator's foot 53, it would also be possible to position it at another part of the body if necessary. This might be the case if it is not possible to operate the switching device 45 by the foot 53, in which case the switching device could be positioned relative to an operator's hand, leg, etc., for example.

The positioning system 50 further comprises a control unit 54, which is connected to the detection unit 51 and/or drive system 52 in order to transmit signals and/or data. This enables the positioning operation relative to the foot 53, the position of which was detected by the detection unit 51, to proceed by activating the drive system 52 via the control unit 54. The control unit 54 is preferably provided in the form of a micro-processor controller in order to process electronic signals and emit other control signals in response to the signals received.

The operation of positioning the switching device 45 may now proceed in such a way that when the foot 53 changes position, this is detected by the detection unit 51, after which a signal representative of the position or change in position of the foot 53 is transmitted by the detection unit 51 to the control unit 54, where the control unit 54 evaluates this signal and then generates a control signal which is transmitted to the drive system 52, which then prompts the switching device 45 to proceed with the change of position. The drive system 52 is preferably activated by the control unit 54 until the switching device 45 is disposed at a pre-definable distance 55 and/or in a pre-definable direction 56. The operation of positioning the switching device therefore preferably continues until a retrievable desired distance between the switching device 45 and the foot 53 of the operator from the actual distance 55 has been reached or almost reached by the control unit 54. The switching device 45 is preferably also positioned relative to the operator's foot 53 so that an operating face 57 of the switching device 45 is oriented in the direction 56 towards the foot 53, and in order to obtain the orientation, the likewise memorized desired distance between the operating face 57 and the foot 53 can be applied by firstly running the operation of orienting the switching device 45 until the direction 56 extending preferably perpendicular to and away from the operating face 57 is oriented towards the foot 53, after which the switching device 45 is moved along in this direction until it has reached the desired distance from the foot 53.

Mention should be made of another possible way of positioning the switching device 45, whereby the position of the switching device 45 is set by the positioning system 50 depending on the work step or working position of the production unit 1, in which case it is only necessary for the detection unit 51 to detect the work step or working position. To this end, the detection unit 51 need only evaluate a control signal emitted by the control device 46 of the production unit 1 and transmit it to the control unit 54, prompting the drive system 52 to change the position until a predefined or predefinable position has been reached in response to the control signal. To this end, the detection unit 51 may also be part of the control device 46 for example, or may be provided in the form of a software program stored in a memory module. This being the case, a position is assigned to every work step or working position of the switching device 45, which essentially corresponds to the position of an operator during the work step.

To improve location or detection of a target object, in particular the foot 53, the detection unit 51 has a detectable element 58, which is preferably attached to the operator's foot 53 and which is readily identifiable by the detection unit 51 as far as possible and is used to simplify the task of determining the position of the foot 53. In this respect, the detectable element is preferably not hard-wired to the detection unit 51 and is freely displaceable relative to the switching device 45.

The properties of the detectable element, such as the material etc., and the design, will depend on the type of detection unit used, as explained in more detail below, and it should be pointed out that the detectable element 58 may also be the foot 53 itself, in which case it should also be pointed out in connection with the system of positioning on the basis of the detectable element 58, that the positioning operation may be based on the foot 53 or another part of the operator's body on which the detectable element 58 is disposed.

The broken lines in FIG. 1 indicate the other production unit 1, which in turn has a transmitter and/or receiver unit 49 for establishing a wireless communication link with the transmitter and/or receiver unit 48 of the switching device 45. Accordingly, the switching device 45 may be configured—as illustrated—so that two production units 1 can be operated by the same switching device 45 as well as activated by it. To this end, it is necessary to define which production unit 1 should establish a connection to the switching device 45 in order to transmit signals and/or data. This may be done by setting frequency ranges, for example, via which the transmitter and/or receiver units 48, 49 will be linked, in which case every transmitter and/or receiver unit 49 can be accessed via a defined frequency range, and a switch can be made from the transmitter and/or receiver unit 48 between the different production units. The assignment of the production unit 1 establishing a communication link to the switching device 45 at any one time may also depend on the position of the detectable element 58 and the switching device 45 disposed in this area, because in this case, only that one of the production units 1 which is closer to the operator can be activated by the switching device 45.

The position of the switching device 45 is preferably changed only within a positioning range 59 which lies in a direct working range of the operator in front of the production unit 1. If necessary, within this positioning range 59, every change in the position of the detectable element 58 will also result in a change in the position of the switching device 54, although slight changes in the position of the detectable element 58 will not lead to a change in position, depending on how the control unit 54 has been configured. If the operator now moves outside this positioning range 59, the switching device 54 continues to be positioned until it has reached a peripheral boundary 60 of the positioning range 59, after which the positioning operation is halted by the positioning system 50 if necessary and the switching device 45 remains in its instantaneous position or the switching device 45 is positioned in a definable position, in particular a zero position. The advantage of defining such a positioning range 59 is that the switching device 45 can only be positioned within the peripheral boundary 60, and the switching device 45 will not undesirably track the operator, for example when it can be concluded that he is moving to locations further away.

The method by which the position of the switching device 45 is detected inside the positioning range 59 in order to keep it there may be the same as that used to detect the detectable element 58, and in this case a distance 61 between the production unit 1 and an operating face 57 of a switching device 45 is detected for example, and if a value defined for the distance 61, which is stored or may be stored, is exceeded, the positioning operation of the switching device 45, is paused and the switching device 45 assumes a position at a distance from the production unit 1 which may be defined in the control unit 54 if necessary, which preferably has a lower value, as a result of which the switching device 45 is not a hindrance on the standing surface 9 when the production unit 1 is not operating.

Figure 2:
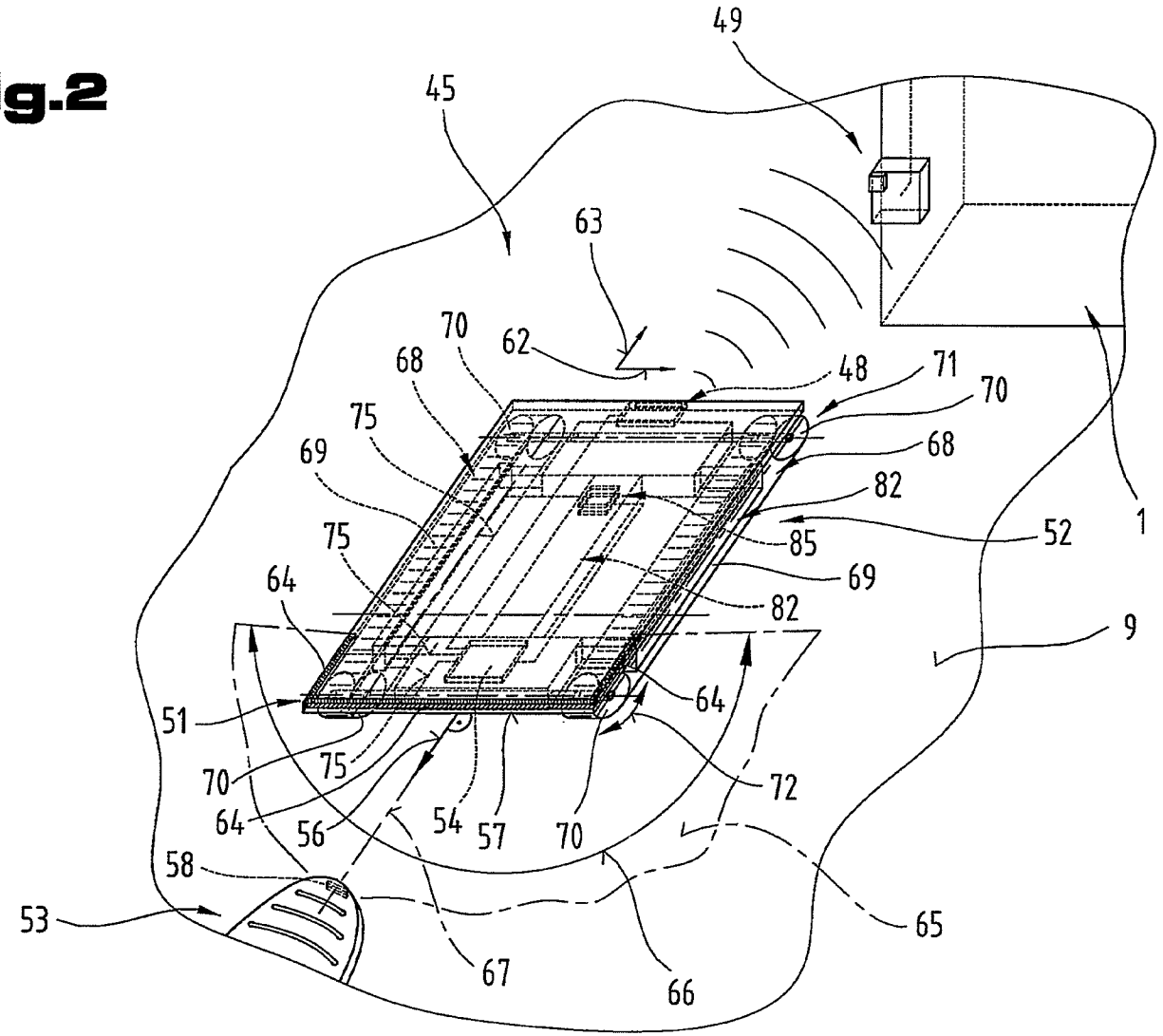
FIG. 2 is a highly simplified, perspective view of a switching device proposed by the invention.
Figure 3:
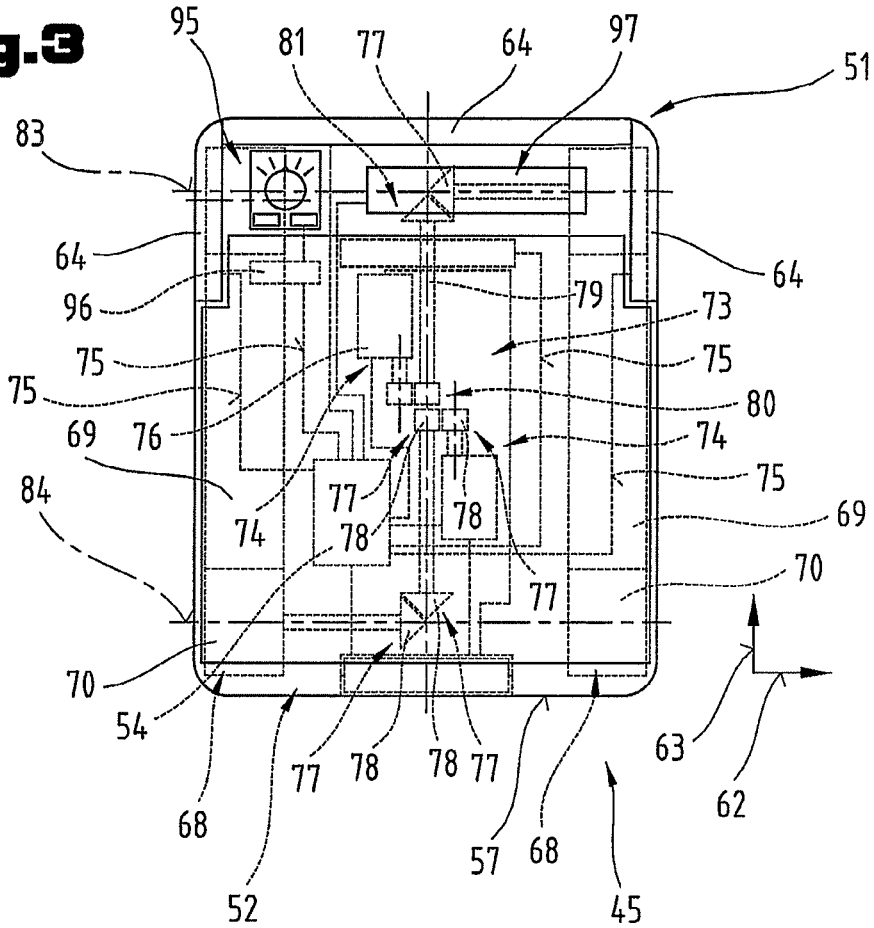
FIG. 3 is a highly simplified plan view of the switching device proposed by the invention.
Figure 4:
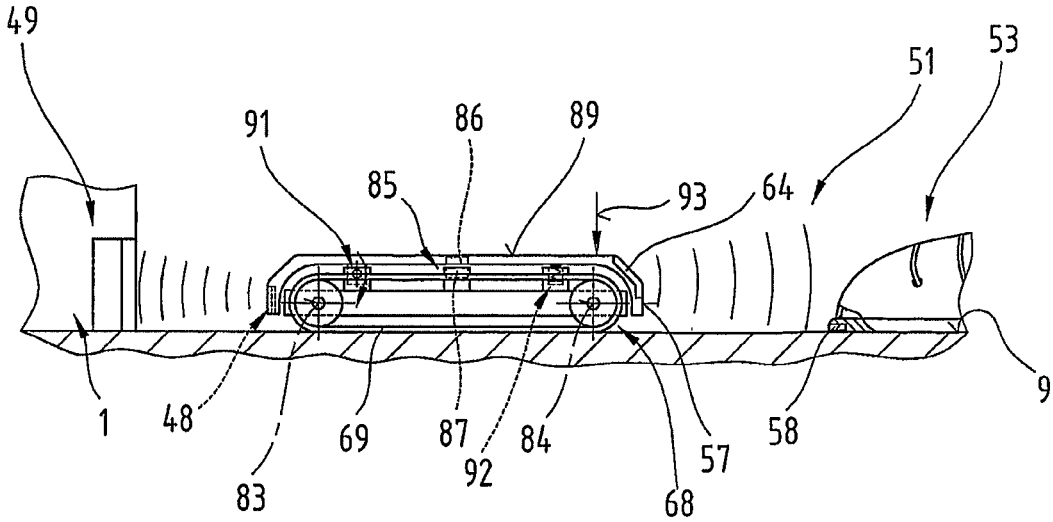
FIG. 4 is a highly simplified, side view of the switching device proposed by the invention.

FIGS. 2 to 4 illustrate a different embodiment of the switching device 45 proposed by the invention, which can be positioned in a two-dimensional system based on co-ordinates 62, 63.

In this example of an embodiment, the detection unit 51 is disposed on the switching device 45 and the detection unit 51 comprises at least one, and in this example of an embodiment three, detection elements 64. The detection elements 64 are disposed on the switching device 45 in the region of the operating face 57 forming a detectable range 65 bounded by the opening angle 66. The position or location of a detectable element 58 can now be detected on the basis of this detectable range 65. The switching device 45 in this instance is preferably oriented so that along the direction 56 extending way from and at least approximately perpendicular to the operating face 57, a connecting line 67 extending between the detectable element 58 and the operating face 57 is as short as possible. This will ensure that the operating face 57 provided for operating purposes is always oriented towards the operator's foot 53 to make manipulation of the switching device 45 easier, as a result of which the switching device 45 can be operated without any problems and the operator does not need to concern himself with its orientation. Another advantage of constantly re-positioning along the connecting line 67 is that it necessarily makes for a relatively small opening angle 66 and hence a small detectable range 65, so that only a few detection elements 64 are needed. The opening angle 66 of the detectable range 65 may naturally also be bigger, relatively speaking, thereby enabling detection over a wider area, and if necessary an opening angle 66 of 360° would also be conceivable, which would mean that the detectable element 58 could be detected in all positions relative to the switching device 45.

Various types of detection elements 64 would be conceivable as a means of detecting an exact position of the detectable element 58 relative to the operating face 57. For example, the detection elements could be provided in the form of an optical sensor, in particular cameras or infrared sensors, a beam or wave emitter creating a wave field, a device for measuring electrical properties such as voltage, capacitance, current, resistance, for example, an acoustic sensor such as a radar, sonar, for example, or by several mutually spaced switches such as floor or mat switches, for example. It would likewise be conceivable to use a mixture of different designs of detection elements for a detection unit, which will result in more exact position detection if necessary.

In order for the positioning system 50 to be able to detect positions exactly, it is necessary for the detectable element 58 to be detectable and identifiable by the detection element 64 at any time without any difficulty. The detectable element 58 need not necessarily be provided as a separate component and instead, existing features on the operator's foot 53 might just as easily be set up as the detectable element 58 by reference to which the switching device 45 is positioned. To this end, it may be necessary to store the characteristic feature to be detected by the detection element 64 in the control unit 54, in which case the positioning system 50 positions the switching device 45 on the basis of this feature, and this characteristic feature might be a color, an indentation, etc., in the shoe worn on the foot 53, in particular a sole. If the detectable element 58 is provided as a separate component, it might be a transponder, metal leaf, plastic leaf, etc., for example, with characteristic features which can be detected and identified without any problem.

If detection is based on a detectable element 58 in the form of an optical sensor designed as an infrared sensor, positioning by the positioning system 50 will be based on the specific heat of the element 58, and it would also optionally be conceivable for positioning to be operated on the basis of heat given off by the foot, which would have a specific value due to the shoe worn. To this end, a temperature stored as a desired data sample set could be retrieved by the control unit 54 and compared with actual data sample sets based on temperatures detected at the different detection elements 64, and the drive system 52 is then activated depending on variances between the desired and actual data sample sets in order to change position. A comparative evaluation of this type by the control device 54 based on desired and actual data sample sets could naturally also be operated using all other detection methods which can be run by the specific designs of detection elements 64, in particular those already mentioned above.

It is also possible to provide the detectable element 58 in the form of a direction transmitter. In this instance, the position of the detectable element 58 is detected by a navigation system which is connected so as to communicate with the control unit 54, and the drive system 52 is then activated by the control unit 54 depending on the position of the detectable element 58 relative to the switching device 45. The navigation system may be a satellite position monitoring system or a local position monitoring system, for example.

It would likewise be possible to provide the detection element 64 in the form of an acoustic sensor, in which case the position and change of position will be detected on the basis of acoustic waves emitted in an acoustical field, in particular ultrasound, which are reflected by the detectable element 58 and detected by the detection unit 51 again on the basis of a propagation time, and the position is determined on the basis of the propagation time and/or changes in the wave properties, e.g. period shifts. To this end, the detection element 64 is provided in the form of a wave emitter creating a wave field which emits acoustic waves in the direction of the standing surface 9 and detects the reflected waves. Other possible ways of detecting position will be explained in more detail below with reference to FIG. 6.

Figure 6:
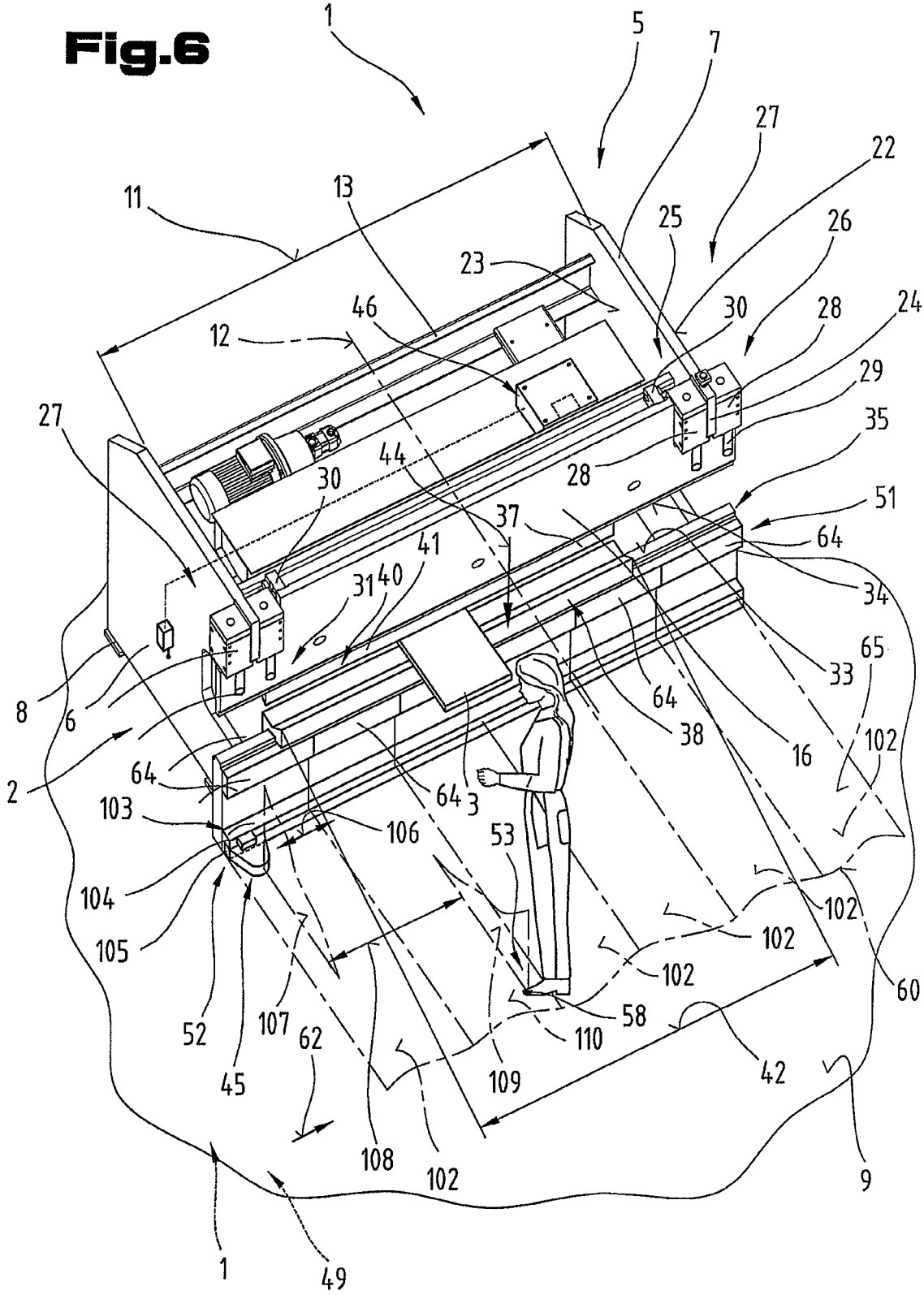
FIG. 6 is a highly simplified, perspective view illustrating the production unit with a different embodiment of the switching device proposed by the invention.

In addition to detecting the element 58 directly by means of a detection unit 51 mounted on the switching device 45, it would also be possible to mount the detection unit 51 on the production unit 1 for example, or on the standing surface 9, for example in the form of a switch mat, as illustrated in more detail in FIG. 6.

It would likewise be possible to provide several detection elements 64 of different designs, in order to take advantage of different position detecting methods so that the detection unit 51 is able to detect the position exactly. Another option is to mount some of the detection elements 64 on the switching device 45 and/or some of them on the production unit 1 and/or some of them on the standing surface 9, which will also increase the accuracy of the position detecting system.

FIG. 2 also illustrates the drive system 52 of the switching device 45, which comprises several drive members 68.

The drive members 68 in this instance are provided in the form of belts 69 respectively circulating around two drive rollers 70, and two drive members 68 are provided. The drive system in the embodiment illustrated as an example is therefore a crawler drive 71, and the two circulating belts 69 circulate from the circulation direction as indicated by arrow 72 around the drive rollers 70. To this end, the belts 69 are in contact with the standing surface 9 on which the circulating belts 69 move the switching device 45, and the belts 69 are preferably made from a material which will ensure good adhesion of the switching device 45 on the ground in order to prevent sliding friction between the standing surface 9 and the belts 69. Also possible are other embodiments with ridge-type recesses around the external circumference, which sit in contact with the standing surface 9. The direction 56 of the switching device 45 can easily be changed by means of such a crawler drive, by operating one of the two belts 69 at a slower circumferential speed than the other belt 69 or moving in the opposite direction of movement from the other 69, without having to provide a steering arrangement.

Another possible embodiment of the drive system 52 is that of a roller drive comprising drive members 68 in the form of rotatable rollers. The rollers are mounted so that they can rotate as necessary and at least three of them, preferably four, are provided, and the change of direction in this instance may be achieved using a steering arrangement to move the rollers about a rotation axis extending essentially perpendicular to the standing surface 9.

FIG. 3 shows a plan view of the switching device 45 proposed by the invention. From this, it may be seen that the drive system 52 has a drive mechanism 73 comprising at least one—in this instance two—drive elements 74. Also illustrated is the control unit 54 which is connected to the drive elements 74 by means of control cables 75 in order to establish communication.

By providing the drive mechanism 73, the drive members 68 can be activated when necessary in order to change the position of the switching device 45. To this end, the drive elements 74 are activated via the control unit 54 by means of a control signal transmitted across the control cables 75, and at least some of the drive members 68 are activated. The drive elements 74 used for this purpose are preferably provided in the form of a motor 76, in particular an electric motor, thereby permitting infinite regulation of the revolutions per minute of the electric motor and hence an infinitely adjustable circumferential speed of the drive members 68 driven by it.

The motion is transmitted from the drive element 74 to the drive members 68 by means of transmission elements 77 for example, in particular a gear 78, which meshes with another transmission element 77 that is coupled with the drive member 68 during displacement. However, it would be possible to use other ways of transmitting motion known from the prior art for this purpose, in which case belt drives, universal drives, etc., would also be conceivable. In order to transmit motion over longer distances, the transmission elements 77 may be provided with transmission shafts 79 if necessary, which engage with one of the drive elements 74 at one end region 80 and at another end region 81 with a transmission element 77 which is coupled with one of the drive members 68 in displacement.

If the drive system 52 is provided in the form of a crawler drive 71, it is preferable if only one of two drive rollers 70 is driven as a means of transmitting motion to the drive member 68 via one of the drive elements 74. The other roller therefore merely rotates at the same time and circulates the belt 69, which is tensed between the two rollers 74, by means of an active frictional or positive connection.

The switching device 45 further comprises a bogie 82, as may best be seen from FIG. 4. Bearing points may be provided on this bogie 82 if necessary, which enable the rollers 70 to rotate about the axes 83, 84. The bogie 82 constitutes the main body of the switching device 45 on which all other components are mounted and by means of which the switching device 45 "is held together". The bogie 82 is therefore preferably also designed to accommodate components which can change position relative to the switching device 45, such as the switching device 45 and the drive mechanism 73 secured to it. A switch arrangement 85 is also provided, preferably at least partially on the bogie 82, by means of which the switching device 45 can be operated when necessary.

In this respect, the switch arrangement 85 is preferably provided in the form of two switch contacts 86, 87 which can be placed in contact and can be operated by applying force to an operating mechanism 88. The operating mechanism 88 is preferably disposed on a top face 89 and can be operated by an operator, optionally by a foot 53. The operating mechanism 88 and the switch arrangement 85 may be based on a foot switch known from the prior art, and the way in which they function will therefore not be described here. It is merely worth pointing out that the operating mechanism 88 of the switch arrangement 85 may be provided in the form of a re-setting rocker switch, re-settable switch, etc.

The operating mechanism 88 is preferably disposed on a cover plate 90, and the operating mechanism 88 has a hinge arrangement 91 disposed in the cover plate 90, about which an operating plate 92 moves when force is applied, as indicated by arrow 93, opposing the force expended by a re-setting element 94 cooperating with the displaceable switch contact 86 in the direction of the switch contact 87 disposed in a stationary mounting in the cover plate. It would also be conceivable for the cover plate 90 to have a deformable covering layer, underneath which the two switch contacts 86, 87 are held in the opened position by means of a re-setting element in the non-operated state and when force is applied to the elastic covering layer, the switch contacts 86, 87 of the switch arrangement 85 are closed and moved into their operating state. The advantage of this is that no moving parts have to be mounted on the switching device 45, such as a pivotable operating plate 94, thereby reducing susceptibility to problems.

When the two switch contacts 86, 87 are closed, a signal is transmitted via the transmitter and/or receiver unit 48 of the switching device 45 to the transmitter and/or receiver unit 49 of the production unit 1, which is transmitted by the transmitter and/or receiver unit 49 to the control device 46 of the production unit 1, which activates the production unit 1 in response to the signal transmitted by the switching device 45. To this end, the switch arrangement 85 is connected either via the control unit 54, or directly, to the transmitter and/or receiver unit 58 in order to establish a communication link.

The control unit 54 may also be connected to an input device 95 for transmitting signals and/or data. Different parameters for operating the switching device 45 can be set up by means of the input device 95 and different operating modes of the switching device 45 retrieved. The different operating modes may be stored in a memory unit 96 and retrieved from the input device 95 and then transmitted via the control unit 54. Parameters and modes which can be defined at the input device 95 may cause the positioning system 50 to be deactivated, a switch to be made between different production units 1 which have to be activated, an adjustment to be made to the procedure being run by the production unit 1 when the switch arrangement 85 is operated, etc. It would also be conceivable for an input and learning mode to be retrieved by means of the input device 95, in which case the nature or properties of the element 58 to be detected can be entered or the properties of the detectable element detected by the detection unit 51 and stored in the memory unit 96. For example, different properties of any elements 58 can be stored in the memory unit 96 and retrieved for the detection operation run by the detection unit 51. To this end, the memory unit 96 is connected so that it can communicate with the control unit 54, enabling desired parameters and desired data sample sets to be stored in the memory unit 96 by entering them manually from the input device 95 so they can be retrieved as necessary. The input device 95 is designed to provide optimum user-friendliness, being provided in the form of a rotatable dial switch, key switch, touch screen, etc., and several such switches or several input devices 95 may be provided, and the input device 95 may be disposed on the production unit 1 to enable parameters to be set at the switching device 45 of the production unit.

The control unit 54 may also optionally be connected to with a display and/or output device of the signal and/or data transmission system, at which current settings or operating modes of the switching device 45 can be output or displayed, preferably optically, making it much easier for the operator to use the switching device 45.

It is also possible for the switching device 45 to have a power source 98, preferably in the form of a battery or accumulator. This power source 98 is used to supply power to all the electrically-operated components and can preferably be re-charged at a charging station and fitted back in the switching device 45.

Figure 5:
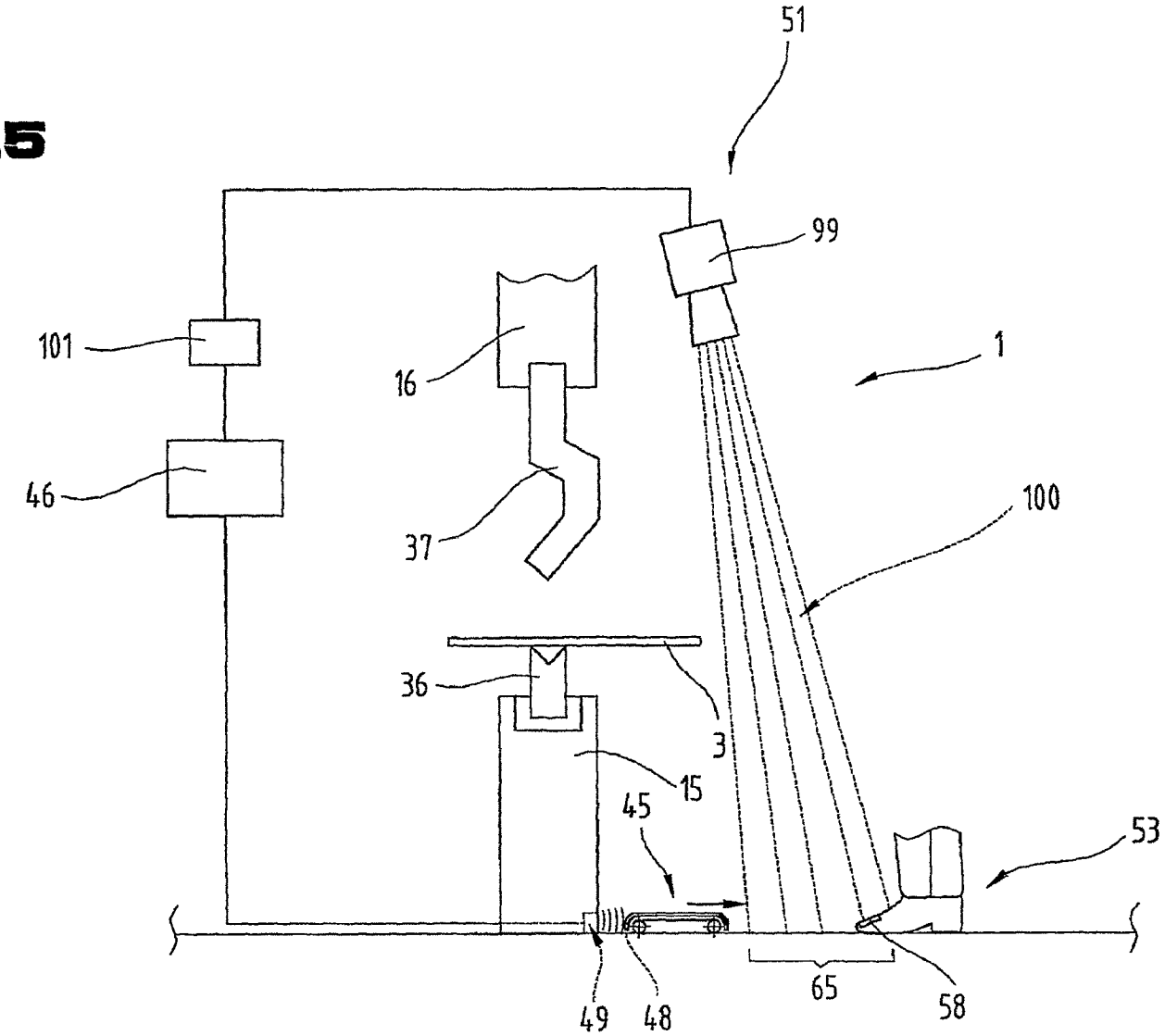
FIG. 5 is a schematic view of another embodiment of a position-changing device.

In the embodiment illustrated as an example in FIG. 5, a detection unit 51 is not provided on the switching device 54 but on the production unit 1, in order to monitor the detectable range 65 on the standing surface 9. The positioning range 59 of the switching device 45 is disposed within this detectable range 65. If the position of the detectable element 58 changes, this will then be detected within the detectable range 65 by the detection unit 51 and transmitted via the transmitter and/or receiver units 68, 69 or via other signal and data transmission means provided for this purpose to the control unit 54 if necessary, so that the drive system 52 can be activated in order to change the position of the switching device 45.

As illustrated in FIG. 5, the detection element 64 is provided in the form of a camera 99, which forms a detection field 100 extending from the camera 99 to the standing surface 9. The camera 99 is connected to an evaluation unit 101, which evaluates the image data transmitted by the camera 99. The evaluation unit 101 may compare the actual image data instantaneously transmitted by the camera 99 representing the current position of the detectable element 58 in the detectable range 65 with electronically stored desired image data, in particular a reference image, and the reference image preferably contains the image data previously supplied to the actual image data. If the evaluation unit 101 finds variances, in particular a change in the position of the detectable element 58, between the desired image data and the actual image data above and beyond a definable tolerance range, the position of the switching device 45 will be changed.

In order to set up a detectable range over a large area, it may be necessary to provide several detection elements 64, thereby providing access to several detectable ranges 65. This may be of advantage because it may be that it is not necessary to detect the position of the detectable element 58 exactly and instead, the detection elements 64 merely detect whether the element 68 is disposed within the detectable range 65 of this respective detection element 64. This enables a compilation of detection sections 102 to be set up corresponding to the detectable ranges 65 of the respective detection elements 64, thereby detecting sections of the detectable element 58, as a result of which the switching device 45 can no longer be infinitely positioned, and instead will be positioned on the basis of the detectable range 65 of one element 64. Positioning the switching device 45 in sections in this manner makes it significantly easier to detect the position of the detectable element 58 by providing a plurality of detection elements 64, each of which covers a detectable range 65, thereby enabling sufficiently accurate positioning of the switching device 45 with respect to the detectable element 68.

In the case of a detection unit 51 based on another embodiment, for example, several magnetic fields may be created along a production unit 1 by the detection elements 64, which are monitored by a measuring system, and the detectable element 58 is provided in the form of a transponder, for example, which induces a measurable change in the magnetic field in which the detectable element 58 is located at that instant. This makes positioning of the switching device 45 to the detection section 102 in which the detectable element 58 is located at that instant relatively easy.

This approach of detecting the position of the element 58 in sections may also be set up using several detection elements in the form of switches disposed at a distance apart from one another, which are designed as pressure-sensitive floor or mat switches on the standing surface 9. A more detailed explanation of how this system of detecting an operator based on sections works will be given in connection with FIG. 6.

FIG. 6 illustrates another embodiment of the switching device 45 proposed by the invention, part of the drive system 52 of which is disposed on the production unit 1.

The drive system 52 in this instance is preferably a linearly displaceable linear guide arrangement 103, which may optionally be mounted on the press beam 15 of the production unit 1 but is preferably mounted on a region of the press beam 16 directed towards the standing surface 9.

The linear guide arrangement 103 is provided the form of a track guide or, as illustrated a guide carriage 104 and a displacement element 105 which can be displaced along it in translation. The displacement element 105 is connected to the switching device 45 during displacements so that when the displacement element is moved along the guide carriage in translation, the switching device 45 also effects the same movement. With the exception of the drive system 52, the switching device 45 may correspond at least partially to the embodiments described above.

As may also be seen from FIG. 6, the switching device 45 is positioned within the two-dimensional system along only one arrow 106. Due to this restriction to the directions of movement of the switching device 45, the detection unit 51 can be further simplified because it is merely necessary to detect whether the detectable element 58 is to the right or left of the switching device 45. If the position of the detectable element 58 changes, for example to the right of the switching device 45, the latter will be moved towards the right by the positioning system 50 until the switching device 45 is preferably on the same level as the detectable element 58. This same level may be defined so that a plane 107 extending through the centre of the switching device 45 essentially perpendicular to the operating face 57 is formed essentially perpendicular to the standing plane 9, which is spaced at a distance 108 from another plane 109 extending essentially through the middle of the detectable element 58 perpendicular to the standing plane 9 after a change in the position of the detectable element 58. Positioning of the switching device 45 then continues until the distance between the two planes 107, 109 has assumed the value of at least approximately 0.

The switching device 45, which can be moved in translation either just above the standing surface 9 or which incorporates additional supporting elements such as guide rollers which roll on the standing plane 9 but are preferably not actively driven, can be moved exactly and in an essentially clearance-free guided action due to the guide carriage 104.

FIG. 6 also illustrates the disposition of the different detection elements 64 of the detection unit 51 which, as illustrated, may optionally be disposed along the press beam 15 so that each creates a detectable range 65 on the standing surface 9 and thus constitutes the detection section 102. This makes it possible to detect in which of the detection sections 102 the detectable element 58 is currently disposed, and this detection section 102 is taken as being the active section 110, and the switching device 45 is then positioned on the basis of this active section 110 as described above. At this stage, it should be pointed out that the methods for detecting the position of body parts described in XXX filed by this same applicant may also be used as a means of detecting the instantaneous position of the foot 53 or detectable element 58.

Figure 7:
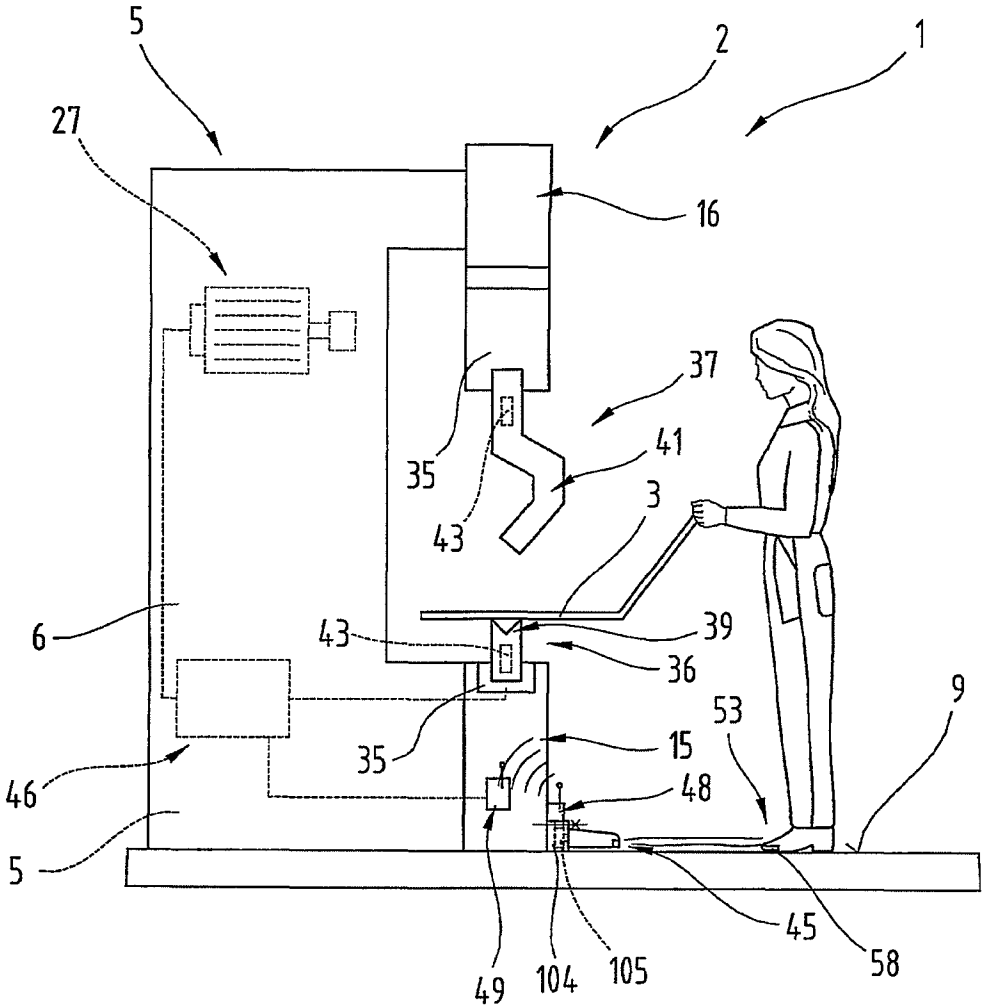
FIG. 7 is a highly simplified, side view of the production unit with a different embodiment of the switching device proposed by the invention.
Figure 8:
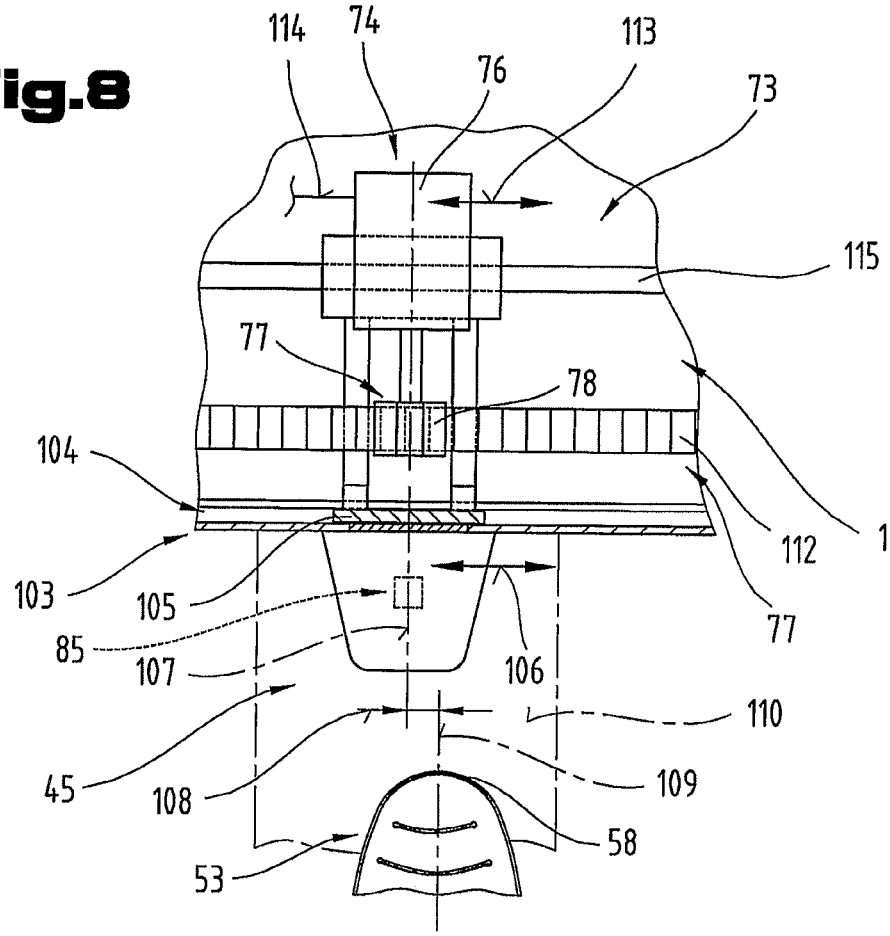
FIG. 8 is a highly simplified exploded diagram showing a front view of the switching illustrated in FIG. 6.

FIGS. 7 and 8 show a side view and a plan view of the linearly displaceable switching device 45. As illustrated, the guide carriage 104 may be secured in the production unit 1 to prevent it from moving using fixing elements 111, for example screws, and the displacement element 105 is mounted in it so that it can be displaced in translation.

FIG. 8 illustrates one possible embodiment of the switching device 45, which has a drive system disposed on the production unit 1. The drive element 74 in this instance is provided in the form of an electric motor and is not disposed on the switching device 45 but in the production unit 1. Also disposed in the production unit 1 is the transmission element 77, provided in the form of a toothed rack 112. The toothed rack 112 engages with the transmission element 77 of the drive element 74, in particular the gear 78, and the drive element 74 can be moved linearly as indicated by arrow 113, and the toothed rack 112 may optionally be secured on the production unit 1 by fixing means to prevent it from moving. The drive element 74 is also actively connected to the control device 46 of the production unit 1 and/or the control unit 54 of the switching device 45 via a cable 114 in order to control and regulate the latter. The switching device 45 is also coupled with the drive element 74 during displacements, so that when the drive element 74 is moved linearly in translation, the switching device 45 is moved as well.

If there a change in the position of the detectable element 58 into another active section 110, this is detected by the detection unit 51 and transmitted to the control device 46 of the production unit 1, which activates the drive element via the cable 114 depending on the change in the position of the element 58 in order to minimize the distance 108 which has occurred between the planes 107, 109 and reduce it to a value of 0. A movement is therefore generated in the direction of arrow 113 because the toothed rack 77 remains stationary on the production unit 1, being prevented from moving, but the transmission element 78 meshing with it effects a rotating movement, thereby causing the drive element 74 to be linearly displaced. To this end, the drive element 74 may be mounted so that it is linearly displaceable in a guide 115, as illustrated, to enable a linear displacement, or is guided by means of the guide carriage 104.

Naturally, it would also be conceivable to mount such a drive element 74 on the switching device 45, in which case there would be no need to provide any separate guides or devices on the production unit 1 in order to displace this drive element, and it would merely be necessary to provide the toothed rack 112.

Another option instead of using the toothed rack 112 as a transmission element 77 would be to use a spindle drive, with a rotatably mounted spindle, preferably mounted in the production unit 1, which is actively connected to the switching device 45, and the rotation of the spindle causes a linear displacement in the direction of arrow 106, in which case the direction of movement will depend on the direction of rotation of the spindle.

Figure 9:
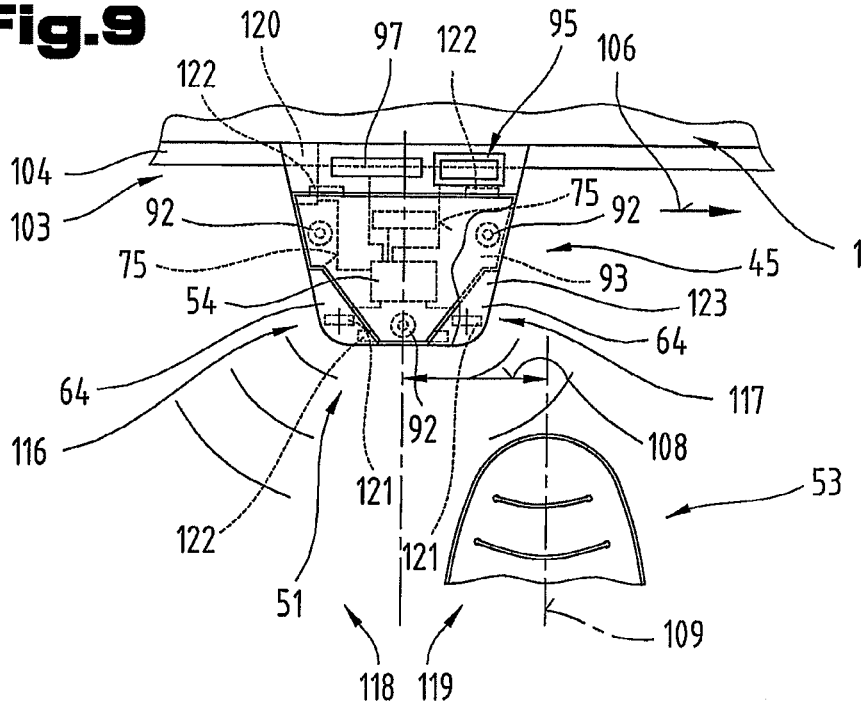
FIG. 9 is a highly simplified exploded diagram showing a front view of the switching device illustrate in FIG. 6 based on another embodiment together with the production unit.

FIG. 9 illustrates another embodiment of the detection unit 51 of the switching device 45, which is linearly displaceable on a linear guide arrangement 103, and a different variant of the linear guide arrangement 103 is also illustrated.

The detection unit 51 in this instance is disposed on the switching device 45 and has essentially two groups of detection elements 56. One detection group 116, comprising at least one detection element 56, monitors one side 118 for changes in movement or changes in the position of the foot 53, and detection group 117 monitors side 119. In this instance, it is conceivable to detect only a change in movement, and there is therefore no need to provide a detectable element on the foot 53—as illustrated—if this is not necessary. When one of the detection groups 116, 177 detects a change in movement or a change in the position of the foot 53, the positioning operation described above is initiated and the drive system 52 used may be based on one of the embodiments described above.

As illustrated, however, it would also be possible to provide the linear guide arrangement 103 in the form of a dovetail guide, which engages with a guide groove 120 of the switching device 45 and thus causes a linear displacement through this guide as indicated by arrow 106, thereby obviating the need for a displacement element 105 (FIG. 7).

FIG. 9 also illustrates support elements 121, which may be provided in the form of rollers, for example, which roll on the standing surface when the switching device 45 is moved linearly. The support elements 121 are mounted so that they can rotate on the switching device 45 without the drive mechanism 73 being driven and preferably serve only as a support for the switching device 45 to prevent any undesired movement out of line or to prevent the occurrence of frictional forces in the linear guide arrangement 103. However, it would also be possible for the support elements 121 to be part of the drive mechanism 73 and be driven by a drive element 74, in which case, due to the contact of the support elements 121 with the standing surface 109, the switching device 45 can be moved by means of active frictional forces, and the rollers have a roller lining made from a rubber-type material in particular, by means of which a high coefficient of rolling friction can be obtained by the material on the standing surface 9.

Also illustrated is the operating plate 94 which operates the switch arrangement 85 when force is applied to it, causing the actuation signal to be sent via the transmitter and/or receiver unit 48 to the control device 46 of the production unit 1. When no force is being expended on the operating plate 94, it is re-set to an initial position by the re-setting elements 92 and the contact between the switch contacts 86, 87 is broken. Stop elements 122 are provided for this purpose, which position the operating plate 94 in the initial position. A covering layer 123 may optionally be provided on this operating plate 94, which is of a design that is as slip-free as possible to enable rapid and simple operation by the foot 53 when stepping on this covering layer 123 and cover plate 94. Such a covering layer 123 may extend across the entire top face of the switching device 45 so that the detection unit is covered by it and any intentional damage to the detection elements 56, such as might be caused by sharp objects dropped from the user's hand, can be ruled out, at least to a certain extent. To this end, the covering layer 123 may be made from an elastic material, which has a high resistance to piercing and is thus protected from being pierced.

In this instance, operation takes place by stepping on the covering layer 123, underneath which is disposed the cover plate 94 on which the moving switch contact 87 of the switch arrangement 85 is mounted and held at a distance apart from the stationary switch contact 86 by means of the re-setting elements 92. When force is applied to the operating plate 94, the switch arrangement 85 closes, transferring the switching device 45 to the operated state. In this embodiment of the operating mechanism 88, no moving elements are accessible to an operator from outside, making inadvertent damage to the operating mechanism 88 unlikely.

For the sake of good order, finally, it should be pointed out that in order to provide a clearer understanding of the structure of the switching device 45 and production unit 1, they and their constituent parts are illustrated to a certain extent out of scale and/or on a larger scale and/or on a smaller scale.

The actual solutions underlying the objective of the invention may be found in the description.

Above all, the individual embodiments of the subject matter illustrated in FIGS. 1, 2, 3, 4; 5; 6, 7, 8; 9 constitute independent inventive solutions. The associated objectives of the invention and the solutions may be found in the detailed description of these drawings.

LIST OF REFERENCE NUMBERS

1 Production unit
2 Press brake
3 Workpiece
4 Housing part
5 Machine frame
6 Stand side panel
7 Stan side panel
8 Damping element
9 Standing surface
10 Base plate
11 Distance
12 Means
13 Wall part
14 Working plane
15 Press beam
16 Press beam
17 Length
18
19 Fixing arrangement
20 End face
21 Leg
22 Side face
23 Side face
24 Leg
25 Actuator drive
26 Actuator drive
27 Drive system
28 Hydraulic cylinder
29 Actuator element
30 Guide arrangement
31 Pivot bearing
32 Bolt
33 End face
34 End face
35 Tool holder
36 Bending tool
37 Bending tool
38 Female die
39 Bending die
40 Male die
41 Bending punch
42 Tool length
43 Support surface
44 Arrow
45 Switching device
46 Control device
47 Foot switch
48 Transmitter and/or receiver unit
49 Transmitter and/or receiver unit

50 Positioning system
51 Detection unit
52 Drive system
53 Foot
54 Control unit
55 Distance
56 Direction
57 Operating face
58 Element
59 Positioning range
60 Peripheral boundary
61 Distance
62 Co-ordinate
63 Co-ordinate
64 Detection element
65 Detectable range
66 Opening angle
67 Connecting line
68 Drive member
69 Belt
70 Drive roller
71 Crawler drive
72 Arrow
73 Drive mechanism
74 Drive element
75 Control cable
76 Motor
77 Transmission element
78 Gear
79 Transmission shaft
80 End region
81 End region
82 Bogie
83 Axis
84 Axis
85 Switch arrangement
86 Switch contact
87 Switch contact
88 Operating mechanism
89 Top face
90 Cover plate
91 Hinge arrangement
92 Re-setting element
93 Operating plate
94 Arrow
95 Input device
96 Memory unit
97 Display and/or output unit
98 Power source
99 Camera
100 Detection field
101 Evaluation unit
102 Detection section
103 Linear guide arrangement
104 Guide carriage
105 Displacement element
106 Arrow
107 Plane
108 Distance
109 Plane
110 Section
111 Fixing element
112 Toothed rack
113 Arrow
114 Cable
115 Guide
116 Detection group
117 Detection group
118 Side
119 Side
120 Guide groove
121 Support element
122 Stop element
123 Covering layer

The invention claimed is:

1. Switching device (45) in the form of a foot switch (47), which is connected to a control device (46) of a production unit (1) in the form of a press brake (2), in order to transmit signals and/or data, and having a positioning system (50) for changing the position, with at least one detection unit (51) and a drive system (52), characterized in that the positioning system (50) comprises a control unit (54) which is actively connected to at least the detection unit (51) and the drive system (52) for transmitting signals and/or data, and the drive system (52) is provided in the form of a bogie (82) with a drive mechanism (73) and at least one drive member (68), and the bogie (82) constitutes a main body of the switching device (45) and the drive system (52) is completely disposed on the switching device (45).

2. Switching device according to claim 1, characterized in that the detection unit (51) comprises at least one detection element (64).

3. Switching device according to claim 1, characterized in that the detection unit (51) comprises a detectable element (58), the position of which can be varied relative to at least one detection element (64).

4. Switching device according to claim 1, characterized in that the detection element (64) is provided in the form of an optical sensor, such as a camera (99) or an infrared sensor.

5. Switching device according to claim 1, characterized in that the detection element (64) is provided in the form of a beam or wave emitter creating a wave field.

6. Switching device according to claim 1, characterized in that the detection element (64) is provided in the form of a device for measuring electrical properties, such as voltage, capacitance, current or resistance.

7. Switching device according to claim 1, characterized in that the detection element (64) is provided in the form of an acoustic sensor, a radar or a sonar.

8. Switching device according to claim 1, characterized in that the detection unit (51) comprises several detection elements (64) in the form of mutually spaced apart switches forming a pressure-sensitive floor or mat switch.

9. Switching device according to claim 1, characterized in that the detection unit (51) comprises several different or identical detection elements (64).

10. Switching device according to claim 1, characterized in that the detection unit (51) is disposed at least partially on the switching device (45).

11. Switching device according to claim 1, characterized in that the drive system (52) has a drive mechanism (73) in the form of at least one drive element (74).

12. Switching device according to claim 1, characterized in that the at least one drive element (74) is connected to the control unit (54) in order to transmit signals and/or data.

13. Switching device according to claim 1, characterized in that the drive element (74) is provided in the form of a motor (76).

14. Switching device according to claim 1, characterized in that the drive element (74) has a transmission element (77) comprising a gear (78), which co-operates with another transmission element (77) of the drive system (52) in order to transmit motion.

15. Switching device according to claim 14, characterized in that at least one other transmission element (77) is coupled with the at least one drive member (68) during displacements.

16. Switching device according to claim 1, characterized in that the drive system (52) is provided in the form of a crawler drive (71), incorporating two belts (69) as drive members (68) which can be operated independently of one another.

17. Switching device according to claim 16, characterized in that the belts (69) respectively circulate between two drive rollers (70), and one of the two drive rollers (70) is preferably connected to one of the drive elements (74) in displacement.

18. Switching device according to claim 1, characterized in that the drive system (52) is provided in the form of a roller drive, in which the drive members (68) are provided in the form of rotatable rollers.

19. Switching device according to claim 1, characterized in that the switching device (45) is provided with a power source (98) in the form of a battery.

20. Switching device according to claim 1, characterized in that at least one switch arrangement (85) is disposed on a top face (89) of the switching device (45), which is connected to the control unit (54) and/or a transmitter and/or receiver unit (48) for transmitting signals and/or data.

21. Switching device according to claim 1, characterized in that the control unit (54) is connected to the transmitter and/or receiver unit (48) for transmitting signals and/or data.

22. Switching device according to claim 1, characterized in that the transmitter and/or receiver unit (48) is wirelessly connected to another transmitter and/or receiver unit (49), assigned to the production unit (1) for transmitting signals and/or data.

23. Switching device according to claim 1, characterized in that the switch arrangement (85) comprises two switch contacts (86, 87) which can be placed in contact.

24. Switching device according to claim 1, characterized in that a cover plate (90) is disposed on the bogie (82), which is provided with an operating mechanism (88) for the switch arrangement (85).

25. Switching device according to claim 1, characterized in that the control unit (54) is connected to an input device (95) for transmitting signals and/or data.

26. Switching device according to claim 1, characterized in that the control unit (54) is connected to a display and/or output device (97) for transmitting signals and/or data.

27. Production unit having a switching device, characterized in that the switching device (45) is as claimed in claim 1.

* * * * *

UNITED STATES PATENT AND TRADEMARK OFFICE

CERTIFICATE OF CORRECTION

PATENT NO. : 8,720,243 B2
APPLICATION NO. : 12/095522
DATED : May 13, 2014
INVENTOR(S) : Gerhard Sperrer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1731 days.

Signed and Sealed this
Twenty-ninth Day of September, 2015

Michelle K. Lee

Michelle K. Lee
*Director of the United States Patent and Trademark Office*